United States Patent [19]

Bareis et al.

[11] Patent Number: 4,792,074

[45] Date of Patent: Dec. 20, 1988

[54] ARRANGEMENT AND THE STEPWISE ADVANCE OF BAND MATERIAL WITH TWO OPPOSITELY DRIVEN FEED ROLLERS

[75] Inventors: Alfred Bareis, Uhingen; Klaus Goebel, Rechberghausen, both of Fed. Rep. of Germany

[73] Assignee: L. Schuler GmbH, Goeppingen, Fed. Rep. of Germany

[21] Appl. No.: 72,749

[22] Filed: Jul. 13, 1987

[30] Foreign Application Priority Data

Jul. 11, 1986 [DE] Fed. Rep. of Germany ..... 3623647

[51] Int. Cl.[4] ..... B65H 20/04

[52] U.S. Cl. ..... 226/149; 226/154; 226/167

[58] Field of Search ..... 226/120, 134, 147, 158, 226/160, 163, 164, 167, 149, 154, 155

[56] References Cited

U.S. PATENT DOCUMENTS

| | | | |
|---|---|---|---|
| 1,275,984 | 8/1918 | Bailey | 226/149 |
| 2,514,261 | 7/1950 | Scheffey | 226/154 X |
| 2,851,676 | 9/1958 | Woodcock et al. | 226/155 X |
| 2,946,586 | 7/1960 | Pityo | 226/154 |
| 3,784,075 | 1/1974 | Portmann | 226/143 |
| 4,040,553 | 8/1977 | Götz | 226/154 X |
| 4,043,494 | 8/1977 | Bickford et al. | 226/149 X |
| 4,106,324 | 8/1978 | Götz | 226/149 X |
| 4,605,147 | 8/1986 | Kato | 226/147 X |

FOREIGN PATENT DOCUMENTS

| | | |
|---|---|---|
| 2114432 | 9/1972 | Fed. Rep. of Germany . |
| 2241686 | 4/1977 | Fed. Rep. of Germany . |

*Primary Examiner*—Stuart S. Levy
*Assistant Examiner*—Joseph J Hail, III
*Attorney, Agent, or Firm*—Barnes & Thornburg

[57] ABSTRACT

An arrangement for the stepwise feed of band material which includes a first, locally fixed and driven feed roller and a second feed roller rotatably supported on a rocker; a lifting mechanism is provided, by which the second feed roller is movable at the point in time of the reversal of the direction of rotatin toward the first feed roller for an advance of the band material and away from the same into a return position in which the band material is to be held fixed. The feed arrangement is designed for an intermediate clearing of the second feed roller and of the guide member by abutment of the guide element on a height-adjustable eccentric and for different thick band materials. In the points of reversal of to and fro movements, the second feed roller as also the pressure device are briefly pressed against the band material.

8 Claims, 3 Drawing Sheets

ARRANGEMENT AND THE STEPWISE ADVANCE OF BAND MATERIAL WITH TWO OPPOSITELY DRIVEN FEED ROLLERS

BACKGROUND AND SUMMARY OF THE INVENTION

The present invention relates to an arrangement for the stepwise feed of band material with two oppositely driven feed rollers, whereby a first feed roller is locally fixedly supported and a second feed roller is adapted to be moved alternately toward the other feed roller, respectively, away from the latter into a return position by means of a lifting device at the instant of the reversal of the direction of rotation, whereby the second feed roller is rotatably supported in a rocker, at one end of which engages a guide element of the lifting device and at whose other end which is located opposite with respect to the axis of the second feed roller, a spring force storage device engages in the direction of the pressure of the second feed roller at the first feed roller.

Arrangements of this type operate at the rhythm, for example, of a press and serve to feed band material to the tool in the press. It is necessary in connection therewith to discontinuously feed the band material in identical band lengths. It is further necessary depending on the type of the work tool, for example, with the use of multiple press tools, to operate in the lower dead-center position of the press ram with an intermediate clearing of the feed rollers and of the pressure device. Therebeyond, the feed arrangement is to be operated with band materials of different thicknesses.

A feed arrangement without free-wheeling devices and brakes for the feed rollers to be used, is described in the DE-PS 22 41 686 in which the band material is held fast during the feed pauses and is released during the feed phases. The arrangement thereby provides two mutually oppositely driven feed rollers, of which a first feed roller is locally fixedly supported and a second feed roller is movable in each case at the instant of the reversal of the direction of rotation toward the other feed roller, respectively, away from this feed roller into a return position by means of a lifting device. The second feed roller is thereby rotatably supported on a rocker. The lifting device engages at one end of the rocker by way of a guide element while a compression spring engages at the other end thereof which is effective in the direction of action of the contact pressure of the second feed roller at the first feed roller. A guide member locally fixedly supported is connected with the rocker between the second feed roller and the point of engagement of the compression spring. A pressure device is taken along together with the guide member which is guided against a locally fixed counter device in the return position of the second feed roller for purposes of holding fast the band material. The guide element is placed by way of a cam follower against a control cam which is rotated directly by the main drive. The rotary movement of the feed rollers is oscillating to and from by way of a connecting rod drive variable as regards the amplitude of the rotary movement. The rocker is supported on both ends by springs. The springs bring about a pivoting of the rocker into the return position with a corresponding cam follower position whereby the second feed roller is lifted off from the band material whereas the pressure device is guided against an abutment under interposition of the band material. During the further pivoting of the rocker, the latter can selectively run up against a pivot point whereby the pressure device can be lifted off at the same time for purposes of an intermediate lifting or clearing. By changing the pivotal connection of the guide element, the feed arrangement can be used for different band material thicknesses. The spring for returning the cam follower along the cam operates during the start of the intermediate clearing mechanism against the abutment spring for the second feed roller whereas both springs engage together at the rocker in one direction of action until the rocker runs up on the pivot point. Differently thick band materials require a manual readjustment of the feed arrangement and they produce thereby different spring forces. A thicker band material increases the pressure or abutment force of the second feed roller whereas the force of the spring acting opposite this spring is reduced in the point of pivotal connection of the guide element.

In contradistinction thereto, it is the object of the present invention to positively guide the movements of the rocker into the forward and return positions.

The underlying problems are solved according to the present invention in that a guide member engages at the rocker between the second feed roller and the point of engagement of the guide element which is locally fixedly and rotatably supported with its other end at approximately the height of the center of the second feed roller, in that a pressure device is connected with the guide member which in the return position of the second feed roller is pressed against a locally fixed counter device under interposition of the band material for holding fixed the band material during the return movement of the first feed roller, and in that a connecting rod engages at the guide element spaced with respect to the point of engagement thereof at the rocker, which is to be driven essentially parallel to the rocker and extending in the direction thereof in a locally fixed bearing support by way of an eccentric.

It is thereby of particular advantage that the feed rollers open and close during standstill of the band material and that with a change of the thickness of the band material and consequently with a required matching of the lifting device, the operating conditions of the lifting device constructed in the manner of a four joint system, do not change. The band feed arrangement is independent of band thickness. The abutment and lifting movements of the second feed roller and of the pressure device at, respectively, away from the band material and the abutment of the guide element at a locally fixed stop takes place by the movement of a single adjusting device.

BRIEF DESCRIPTION OF THE DRAWINGS

These and other objects, features and advantages of the present invention will become more apparent from the following description when taken in connection wit the accompanying drawing which shows, for purposes of illustration only, one embodiment in accordance with the present invention and wherein.

DETAILED DESCRIPTION OF THE DRAWINGS

Figure 1:
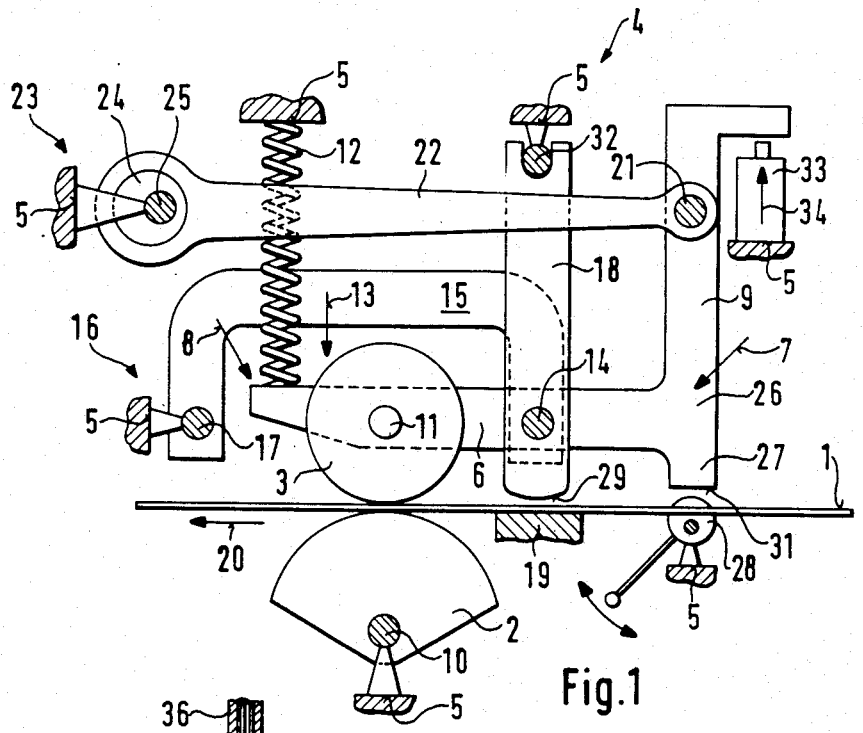
FIG. 1 is a simplified schematic view of a lifting arrangement in accordance with the present invention.

Referring now to the drawing wherein like reference numerals are used throughout the various views to designate like parts, according to FIG. 1 the band material 1 is advanced stepwise in the direction of the arrow 20 by a predetermined adjustable amount. The feed takes place by means of feed rollers 2 and 3 of which the feed roller 2, as shown, may be constructed as segment and is supported in a locally fixed rotary bearing by way of a pivot shaft 10 so as to be pivotal to and fro. The feed roller 3, which may be a driving roller, a press-driven roller, as also a roller driven by the band material 1, i.e., a follower roller, is rotatably supported on a rocker 6 at 11. The rocker 6 is loaded by a spring force storage device as, for example, by a pressure cylinder or, as illustrated, by a compression spring 12 engaging in the end part 8 of the rocker 6 (arrow 13) to provide an abutment pressure of the feed roller 3 at the band material 1 and to stabilize the lifting mechanism generally designated by reference numeral 4. The rocker 6 is rigidly connected at 26 within the area of its second end part 7 with a guide element 9. A common point of rotation 14 for a guide member 15 rotatably supported at 16 in a locally fixed bearing support 17 and for a rotatable pressure device 18 longitudinally guided at a locally fixed place 32 is located between this point of engagement 26 of the guide element 9 at the rocker 6 and the feed roller 3. The spherical bottom side 29 of the pressure device 18 is provided locally opposite a counter member 19. A stop 28 adjustable at least in height, for example, a manually or also motor-adjustable eccentric is disposed opposite the downwardly facing band bottom side 31 in the end part 27 of the guide element 9 laterally for the band guidance of the band material 1. A connecting rod 22 is supported at the guide element 9 in a pivot bearing 21 spaced with respect to the point of engagement 26 of the guide member 9 at the rocker 6; the connecting rod 22 is guided at the other end thereof by way of an eccentric 24 and an eccentric shaft 25 in the locally fixed bearing point at 23. An adjusting means 33, for example, a pressure cylinder, may engage in the direction of action of the arrow 34 at a point of the thus-formed four-joint or four-link system. The frame to which the locally fixed points 10, 17, 23 and 28 refer, is generally designated by reference numeral 5.

Figure 2:
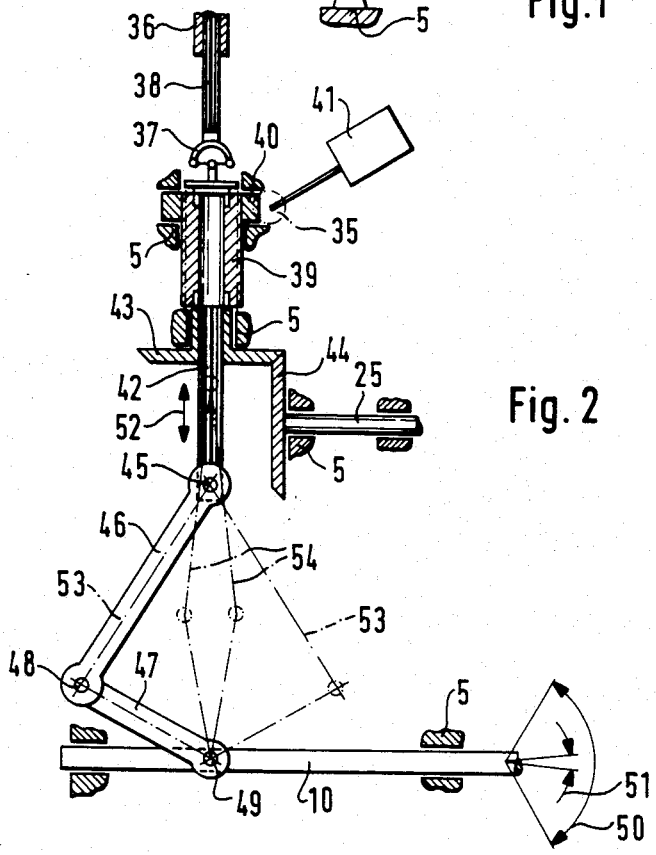
FIG. 2 is a somewhat schematic view of a drive mechanism for the lifting arrangement and the feed roller movement according to FIG. 1.

According to FIG. 2, the eccentric shaft 25 is driven by way of bevel gears 43 and 44 while the oscillating shaft 10 is driven, for example, by way of an oscillating drive as described in the DE-OS No. 21, 14 432. These two drives are illustrated simplified in FIG. 2. A spline shaft 38 is axially movably guided in a shaft 36 driven, for example, by a press and having a spline shaft profile; the spline shaft 38 transmits by way of a universal joint 37 the rotary movement of the hollow shaft 36 to a threaded bushing 39. The threaded bushing 39 is rigidly connected with a further spline shaft 42. The locally fixedly supported bevel gear 43 is guided on the spline shaft 42; the bevel gear 43 meshes with the bevel gear 44 on the eccentric shaft 25. The rotary drive which comes from the press is thus directly transmitted to the eccentric shaft 25. A guide rod pair 46 is secured at the lower end of the spline shaft 42 by way of one pivot joint 45 each. A further guide rod pair 47 is pivotally connected at the downwardly directed second end part of the guide rod pair 46 by way of a universal joint arrangement 48, the guide rod pair 47 is pivotally connected with its opposite end part at the oscillating shaft 10 by way of a pivot joint 49 on both sides thereof. By changing the height position of the pivot joint 45—change of the distance of the pivot joint 45 to the oscillating shaft 10—the guide system consisting of the guide rod pairs 46 and 47 is changed between the maximum and minimum positions designated by reference numerals 53 and 54. The height adjustment of the spline shaft 42 in the direction of the double-arrow 52 takes place by way of the threaded bushing 39. The latter is adjustable together with the spline shaft 42, the universal joint 37 and the spline shaft 38 in the direction of the double-arrow 52 by way of an adjusting means 41, for example, a hydraulic motor. The adjusting means 41 acts by way of a worm 35 on a locally fixed ring nut 40 threadably secured on the threaded bushing 39, whose rotation effects an axial adjustment of the threaded bushing 39 in the ring nut 40. The maximum deflection 50 and the minimum deflection 51, which correspond to the positions 53 and 54 of the guide rod pairs 46 and 47 are indicated at the oscillating shaft 10.

Figure 3:
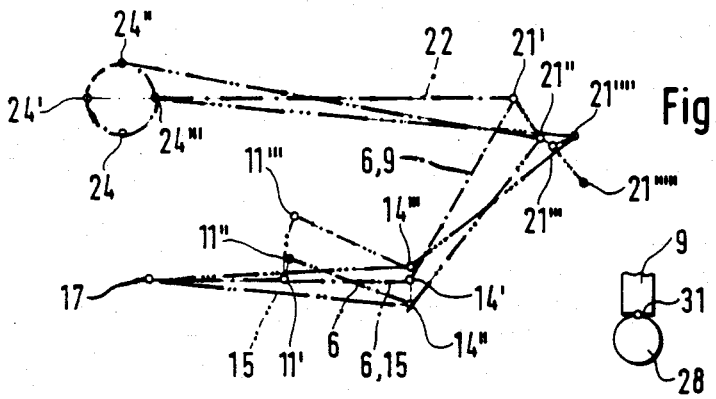
FIG. 3 is a schematic diagram of the operation of the lifting arrangement according to FIG. 1.

In FIG. 3, the guide members and pivot bearings are designated corresponding to FIG. 1. The second feed roller 3 whose axis 11 is illustrated in the positions 11', 11' and 11''' rests on the band material 1 for the forward movement of the band material during the rotation of the eccentric 24 from the position also indicated by reference numeral 24 into the position 24'', illustrated by the position 11' on the rocker 6 and in FIG. 4. During the rotation of the eccentric 24 by way of the position 24' into the position 24'' the common point of pivotal connection 14 for the pressure device 18 moves from the position 14' into the position 14'' so that it will lead for a short period of time t a simultaneous contact of the feed roller 3 and of the pressure device 18 with the band material 1. The point of pivotal connection 21 of the connecting rod 22 at the guide element 9 moves thereby from the position 21' into the position 21'' along a part of a circular arc about the axis 11 in the position 11'. After the eccentric 24 passes through the position 24'', the point of pivotal connection 21 moves from the position 21'' initially along a portion of circular arc about the point 14.. into the position 21''' because the pressure device 18 rests on the band material 1. During this period of time, the axis 11 of the feed roller 3 moves from the point 11' to the point 11''. The feed roller 3 thus lifts off from the band material 1 when the eccentric 24 passes through the position 24'' (FIG. 5). The further rotation of the eccentric 24 into the position 24''' effects an abutment of the guide element 9 on the height-adjustable step 28. Depending on the position of the eccentric 28 in dependence on the required extent of the intermediate clearing, the guide element 9 arrives sooner or later into abutment on the stop 28 (FIG. 6) so that tee length of the portion of the circular arc between the positions 21'' and 21''' is dependent therefrom. Upon reaching the position 21''' and after passing through the point 24''' of the eccentric 24, the pressure device 18 lifts off from the band material 1. The point of pivotal connection 14 is moved from the position 14'' into the position 14''' along a circular arc about the guide member bearing 17. The point 21 moves from the position 21''' into the position 21''''. During a further rotation of the eccentric from the position 24''' into the position 24, the bearing place 21 is moved back on the previously traversed path into a center position between the positions 21' and 21''. Upon reaching the position 24 of the eccentric, at first the pressure device 18 and thereafter the feed roller 3 come to rest on the band material 1. With the beginning of the feed of the band material 1, approximately in the position 24 of the eccentric, the pressure device 18 must have lifted off anew from the band material 1. In case that an intermediate clearing is not necessary, the eccentric 28 is adjusted back so far that the lower edge 31 of the guide element 9 does not come into contact with the eccentric 28. The point of pivotal connection 21 of the connecting rod 22 moves in this case along an extended path portion of the circular arc about the point of pivotal connection 14 in the position 14'' from the position 21''' into the position 21'''''.

Figure 1A:
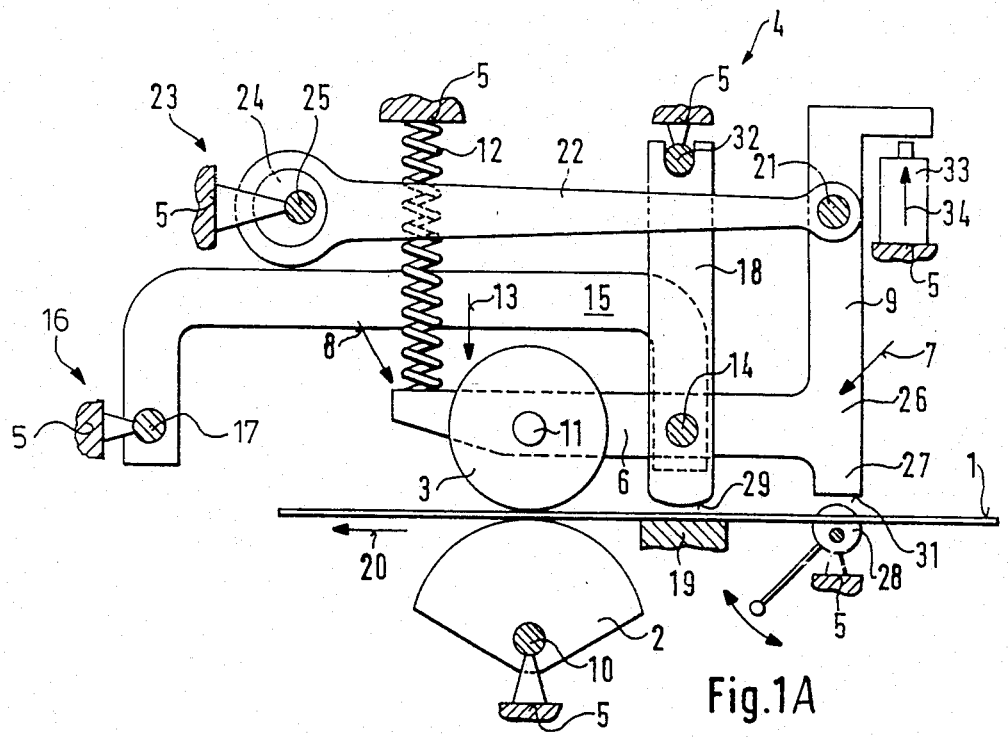
FIG. 1A is a variant of FIG. 1 with a longer guide member.

FIG. 1A illustrates a variation of the device of FIG. 1 wherein guide member 15 is elongated such that its effective length is the same as the connecting rod 22. With this type of arrangement the pivot point 17 will be moved to the left (FIG. 3) to provide a different lift response to roller 3 attached by pin 11 to the rocker 6.

Figure 4:
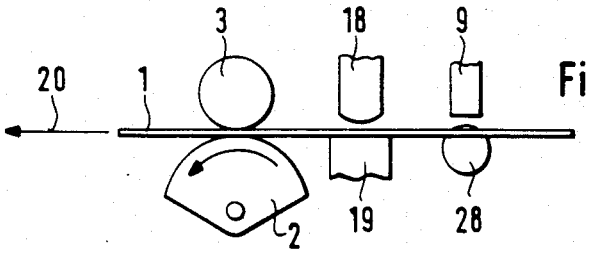
FIGS. 4 to 6 are schematic views illustrating the relative positions of the feed roller, pressure device and guide element in accordance with the present invention which are brought about by the rocker.
Figure 5:
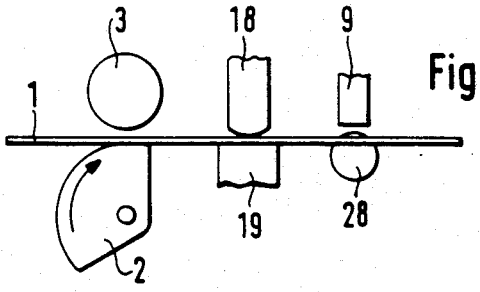

FIG. 4 illustrates the abutment of the feed roller 3 pressed against the feed roller 2 under interposition of the band material 1, i.e., for the feed of the band material during the eccentric rotation from the position 24 into the position 24''.

FIG. 5 illustrates the time interval of the return of the feed roller 2, in which the band material 1 is to be held between the pressure device 18 and the counter member 19.

Figure 6:
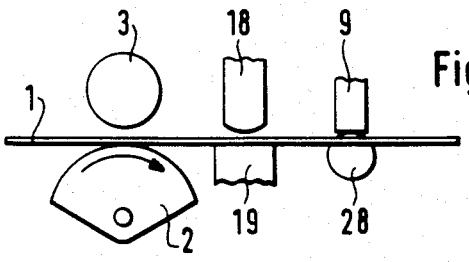

FIG. 6 illustrates the interval during standstill of the band material 1, in which an intermediate clearing takes place.

While we have shown and described only one embodiment in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. An arrangement for the stepwise feeding of band material, comprising two oppositely driven feed roller means, a first one of said feedroller means being locally fixedly supported and a second feed roller means being alternately movable by a lifting means toward the first feed roller means or away from the latter into a return position at the point in time of reversal of the direction of rotation of at least one of the feed roller means, the second feed roller means being rotatably supported in a rocket means, said lifting means including a guide element engaging at one end of the rocker means and a spring force storage means engaging at the other end of the rocker means disposed opposite with respect to the axis of the second feed roller means, the direction of action of the spring force storage means being in the direction of the abutment of the second feed roller means at the first feed roller means, guide means engaging at the rocker means between the second feed roller means and the point of engagement of the guide element at the rocker means near one end of the guide means, said guide means being locally fixedly and rotatably supported with its other end approximately at the height of the center of the second feed roller means, a pressure device operatively connected with the guide means which in the return position of the second feed roller means is operable to be pressed against a locally fixed counter member under interposition of the band material for purposes of holding the band material during the return movement of the first feed roller means, a connecting rod engaging at the guide element at a point spaced with respect to the point of engagement thereof at the rocker means, the connecting rod being operable to be driven by way of an eccentric means in a locally fixed bearing support substantially parallelly to the rocker means and extending in the direction thereof.

2. An arrangement according to claim 1, wherein the rocker means and the guide element are rigidly connected with each other at the point of engagement of the guide element at the rocker means, the guide element being operable to be guided with an end part directed toward the band against a height-adjustable and locally fixed stop means, and the eccentricity of the eccentric means for the connecting rod, the diameter of the second feed roller means and the center distance thereof to the band material as well as the distance of the bottom edge of the pressure device with respect to the band material and the distance of the bottom edge of the guide element with respect to the stop means being so adjusted that during rotation of the eccentric means of the connecting rod, the second feed roller means lifts off from the band material when the pressure device is guided against the band material and the pressure device lifts off from the band material when the guide element is moved against the stop means.

3. An arrangement according to claim 1, wherein the pressure device, on the one hand, is rotatably supported in the rocker mean and, on the other, is longitudinally guided and rotatably supported in a locally fixed bearing means.

4. An arrangement according to claim 3, wherein the rocker means and the guide element are rigidly connected with each other at the point of engagement of the guide element at the rocker means, the guide element being operable to be guided with an end part directed toward the band against a height-adjustable and locally fixed stop means, and the eccentricity of the eccentric means for the connecting rod, the diameter of the second feed roller means and the center distance thereof to the band material as well as the distance of the bottom edge of the pressure device with respect to the band material and the distance of the bottom edge of the guide element with respect to the stop means being so adjusted that during rotation of the eccentric means of the connecting rod, the second feed roller means lifts off from the band material when the pressure device is guided against the band material and the pressure device lifts off from the band material when the guide element is moved against the stop means.

5. An arrangement according to claim 3, wherein the distances from the eccentric means and point of pivotal connection of the connecting rod at the guide element and from the locally fixed bearing means of the guide means and point of pivotal connection of the guide means at the rocker means are of substantially equal length, and further comprising adjusting means adjustable mounted adjacent the guide element which is adjustable essentially in the direction and opposite direction of the direction of action of the spring force storage means.

6. An arrangement according to claim 5, wherein the rocker means and the guide element are rigidly connected with each other at the point of engagement of the guide element at the rocker means, the guide element being operable to be guided with an end part directed toward the band against a height-adjustable and locally fixed stop means, and the eccentricity of the eccentric means for the connecting rod, the diameter of the second feed roller means and the center distance thereof to the band material as well as the distance of the bottom edge of the pressure device with respect to the band material and the distance of the bottom edge of the guide element with respect to the stop means being so adjusted that during rotation of the eccentric means of the connecting rod, the second feed roller means lifts off from the band material when the pressure device is guided against the band material and the pressure device lifts off from the band material when the guide element is moved against the stop means.

7. An arrangement according to claim 1, wherein the distances from the eccentric means and point of pivotal connection of the connecting rod at the guide element and from the locally fixed bearing means of the guide means and point of pivotal connection of the guide means at the rocker means are of substantially equal length, and further comprising adjusting means pivotally connected at the guide element which is adjustable essentially in the direction and opposite direction of the direction of action of the spring force storage means.

8. An arrangement according to claim 1, wherein the rocker means and the guide element are rigidly connected with each other at the point of engagement of the guide element at the rocker means, the guide element being operable to be guided with an end part directed toward the band against a height-adjustable and locally fixed stop means, and the eccentricity of the eccentric means for the connecting rod, the diameter of the second feed roller means and the center distance thereof to the band material as well as the distance of the bottom edge of the pressure device with respect to the band material and the distance of the bottom edge of the guide element with respect to the stop means bieng so adjusted that during rotation of the eccentric means of the connecting rod, the second feed roller means lifts off from the band material when the pressure device is guided against the band material and the pressure device lifts off from the band material when the guide element is moved against the stop means.

* * * * *